US006533238B2

(12) United States Patent
Barnes et al.

(10) Patent No.: US 6,533,238 B2
(45) Date of Patent: Mar. 18, 2003

(54) VERSATILE ANTI-TIP BRACKET FOR AN APPLIANCE

(75) Inventors: Shelton T. Barnes, Chattanooga, TN (US); James David Hancock, Cleveland, TN (US); David Charles Ometer, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/902,167

(22) Filed: Jul. 11, 2001

(65) Prior Publication Data

US 2003/0010886 A1 Jan. 16, 2003

(51) Int. Cl.[7] ..... F16M 1/00

(52) U.S. Cl. ..... 248/680; 248/673; 248/677; 248/502

(58) Field of Search ..... 248/680, 673, 248/674, 677, 500, 502, 501, 220.21, 225.11

(56) References Cited

U.S. PATENT DOCUMENTS

| | | | | |
|---|---|---|---|---|
| 4,669,695 A | | 6/1987 | Chou | 248/500 |
| 4,754,948 A | | 7/1988 | Casciani | 248/680 |
| 4,890,813 A | | 1/1990 | Johnson et al. | 248/680 |
| 5,076,525 A | | 12/1991 | Whipple | 248/300 |
| 5,174,543 A | | 12/1992 | Corson et al. | 248/680 |
| 5,176,437 A | | 1/1993 | Remington | 312/351.1 |
| 5,487,523 A | * | 1/1996 | Ingram et al. | 248/551 |
| 5,624,098 A | | 4/1997 | McDowell | 248/550 |
| 5,645,258 A | | 7/1997 | Flowers | 248/298.1 |
| 5,664,749 A | * | 9/1997 | Kump et al. | 248/220.22 |
| 5,699,993 A | | 12/1997 | Hill et al. | 248/680 |
| 5,749,550 A | * | 5/1998 | Jackson | 248/188.2 |
| 5,954,307 A | * | 9/1999 | Williams | 248/501 |

* cited by examiner

*Primary Examiner*—Leslie A. Braun
*Assistant Examiner*—A. Joseph Wujciak, III
(74) *Attorney, Agent, or Firm*—Diederiks & Whitelaw, PLC

(57) ABSTRACT

A bracket for properly positioning and preferably preventing the tipping of an appliance includes first and second, generally perpendicular legs extending from a central bracket portion, with the first leg being longer than the second leg. Each of the legs is provided with a slot extending to a terminal end thereof and is defined by side flanges which are interconnected by a raised connecting portion. Apertures are provided in the side flanges for use in securing the bracket to a supporting surface or an upstanding wall. In addition, the central portion includes a recess formed with holes for use in toe nailing or screwing the bracket in place. The bracket is adapted to be secured in place with a selected one of the legs extending along the supporting surface in order that a support leg of an appliance can be slid beneath and retained by the bracket.

19 Claims, 4 Drawing Sheets

VERSATILE ANTI-TIP BRACKET FOR AN APPLIANCE

BACKGROUND OF THE INVENTION

1. Field of the Invention

The present invention pertains to the art of domestic appliances and, more particularly, to a bracket preferably designed to prevent a selected one of various free-standing appliances from tipping over during use.

2. Discussion of the Prior Art

Certain domestic appliances, particularly ranges and dishwashers, can be subjected to loads which tend to undesirably tip the appliance during use. For instance, during use of a conventional range, it is often necessary to open an oven door of the appliance. In this condition, subjecting the door to a downward force beyond a certain threshold can result in tipping of the appliance. For obvious reasons, it is desirable to avoid the potential for such a tipping action.

This potential tipping problem has been heretofore recognized and addressed in various fashions. To this end, there exists a fair number of U.S. patents directed to anti-tip arrangements for appliances. For instance, U.S. Pat. Nos. 4,669,695, 4,754,948, 5,076,525 and 5,174,543 disclose anti-tip brackets for use with ranges, wherein a portion of each bracket is adapted to be attached to a wall against which the appliance is positioned. In accordance with the '695, '948 and '525 patents, one leg of a generally L-shaped bracket is attached to the wall and a second leg of the bracket projects into an opening formed in a rear cabinet portion of the range. In accordance with the '543 patent, hook members are adapted to engage a tether cable secured to the back of the cabinet.

Another known type of anti-tip arrangement provides for fixing an anchor to a supporting surface for an appliance, with the anchor including structure which is interengaged with a rear portion of the appliance. In this manner, the rear of the appliance cannot be unintentionally lifted. For example, each of U.S. Pat. Nos. 4,890,813, 5,176,437 and 5,624,098 is directed to an anti-tipping arrangement for an appliance or cabinet including a bracket or plate which is adapted to be mounted at a lower portion of the appliance/cabinet and affixed to a supporting floor through the use of screws. For instance, the '098 patent is directed to a bracket including a raised central portion and a pair of side flanges. The central portion is provided with an elongated slot which is adapted to extend about a shaft portion of a leveling leg of a range. In this manner, the bracket prevents the leveling leg from lifting off of the floor beyond a minimal amount. In accordance with the '813 patented arrangement, an elongated, floor mounted bracket is provided across a rear surface of a range and includes a ledge section adapted to project over bases of rear appliance leveling legs.

Although these known arrangements address prior concerns relating to the tipping of certain appliances, the devices are really only designed to be mounted in a specific manner and used with particular appliance units. In other words, each device is limited in the manner in which the device is secured to surrounding supporting structure and generally dedicated for use with a predetermined appliance. Therefore, there still exists a need in the art for an anti-tipping device which includes structure enabling the device to be used in connection with various different types of appliances and a wide range of mounting scenarios.

SUMMARY OF THE INVENTION

The present invention is directed to a bracket designed to be used in combination with a free-standing appliance for use in establishing and maintaining a desired positioning of the appliance and, most preferably, preventing the appliance from tipping over. In accordance with the most preferred embodiment of the invention, the bracket is generally L-shaped, including one long leg and one shorter leg. Each of the legs is defined by a central raised portion, as well as a pair of outwardly extending lower flange portions. Each leg is formed with an elongated slot, in the central portion thereof, which opens at a respective terminal end of the leg. At the juncture of the two legs, the bracket is formed with a plurality of holes.

With this construction, the bracket is can be readily mounted in a fixed position to either an adjacent wall or a supporting floor, with a selected one of the slots being arranged to receive a portion of a rear leveling support leg of the appliance. In addition, given the incorporation of varying length legs and the holes at the leg juncture area, the bracket can be easily mounted in numerous ways. Therefore, the bracket can take various configurations based on its selected orientation and can be secured in a desired position in several ways. In this manner, the bracket arrangement of the present invention advantageously represents an extremely versatile anti-tipping system.

Additional objects, features and advantages of the present invention will become more fully apparent from the following detailed description of a preferred embodiment of the invention when taken in conjunction with the drawings wherein like reference numerals refer to corresponding parts in the several views.

DETAILED DESCRIPTION OF THE PREFERRED EMBODIMENT

Figure 1:
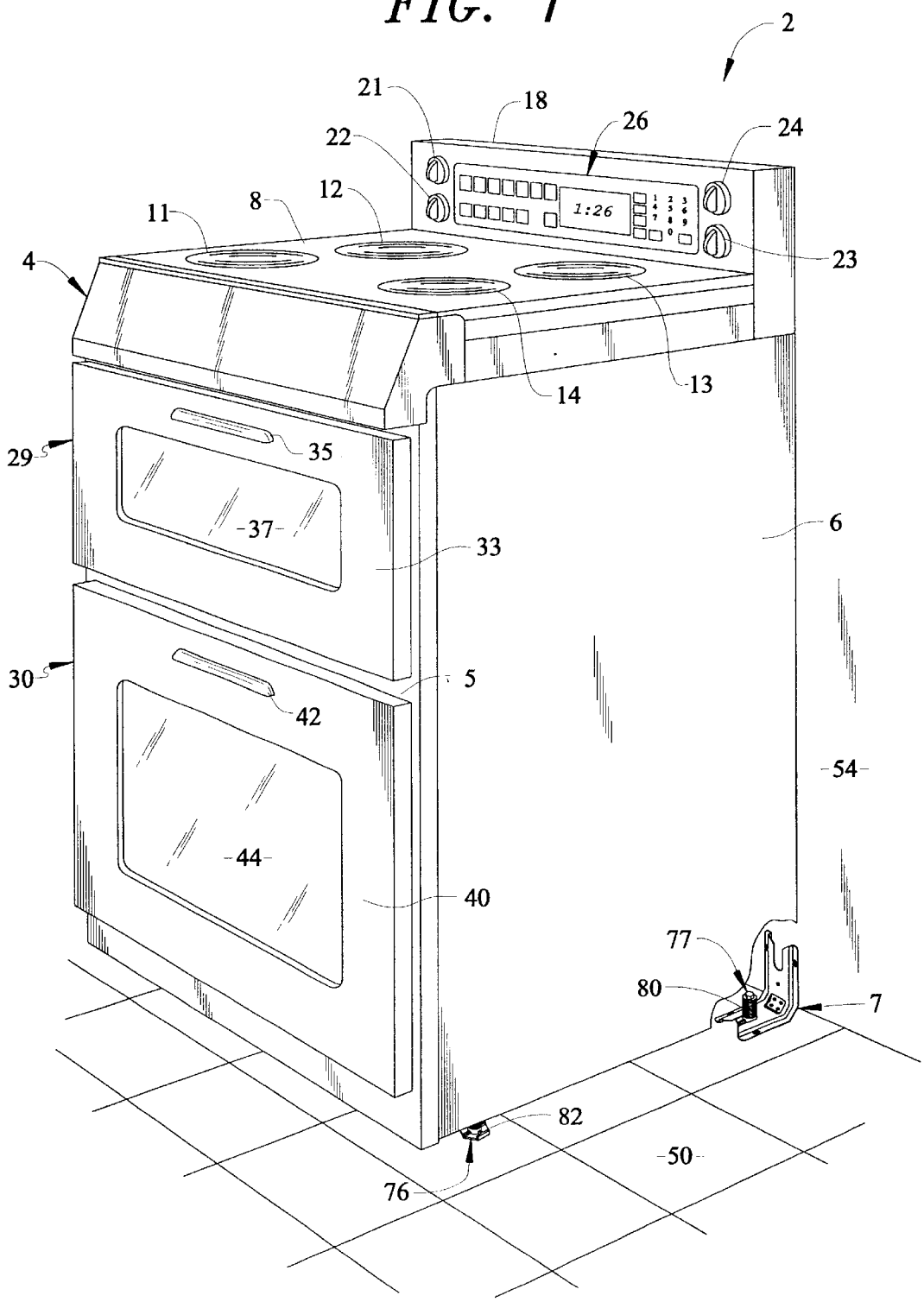
FIG. 1 is a right perspective view of a range shown with a partially broken away lower rear portion illustrating an anti-tip bracket constructed in accordance with a preferred embodiment of the invention.
Figure 2:
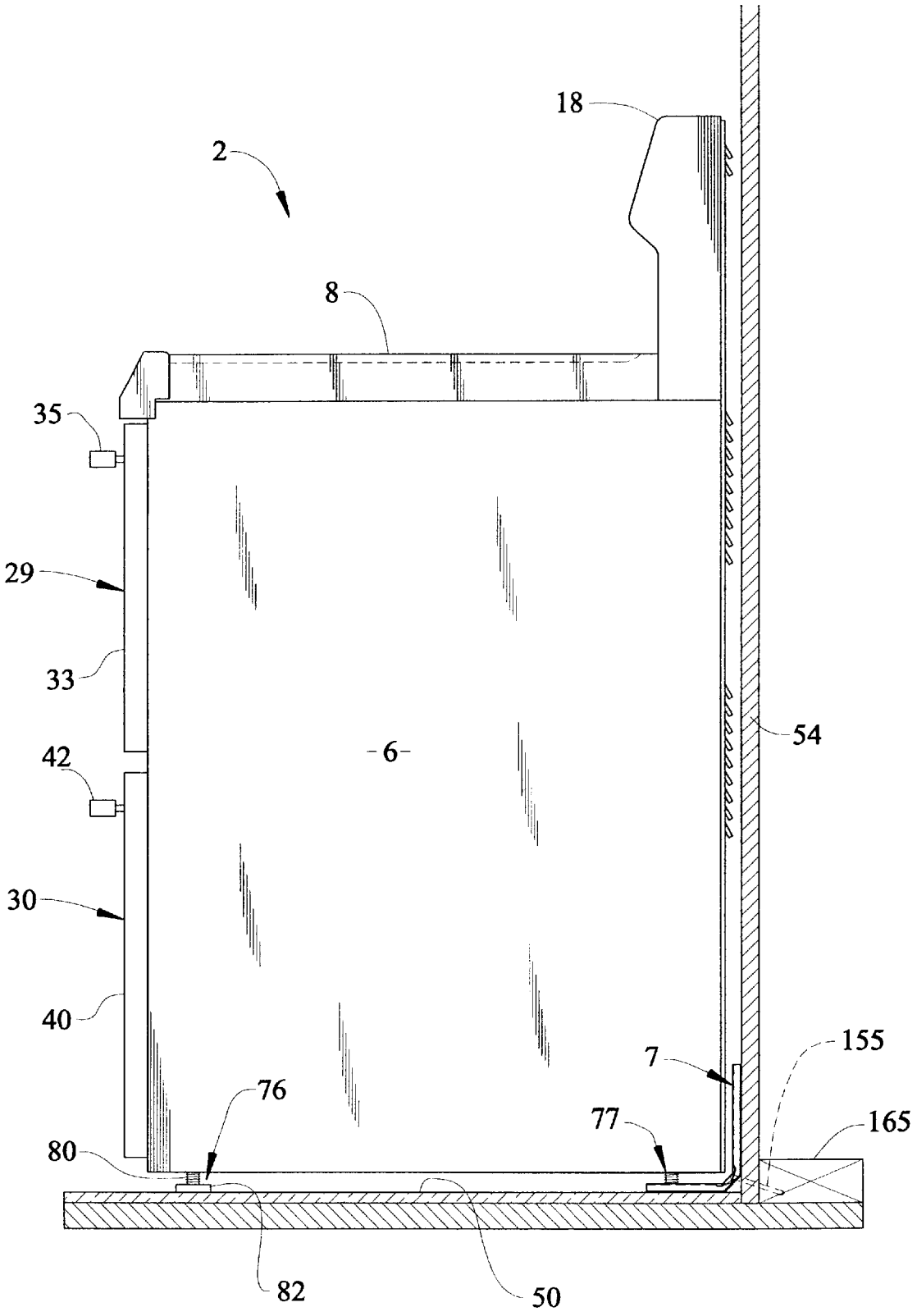
FIG. 2 is a side view of the range of FIG. 1 positioned on a supporting surface directly adjacent an upstanding wall.
Figure 3:
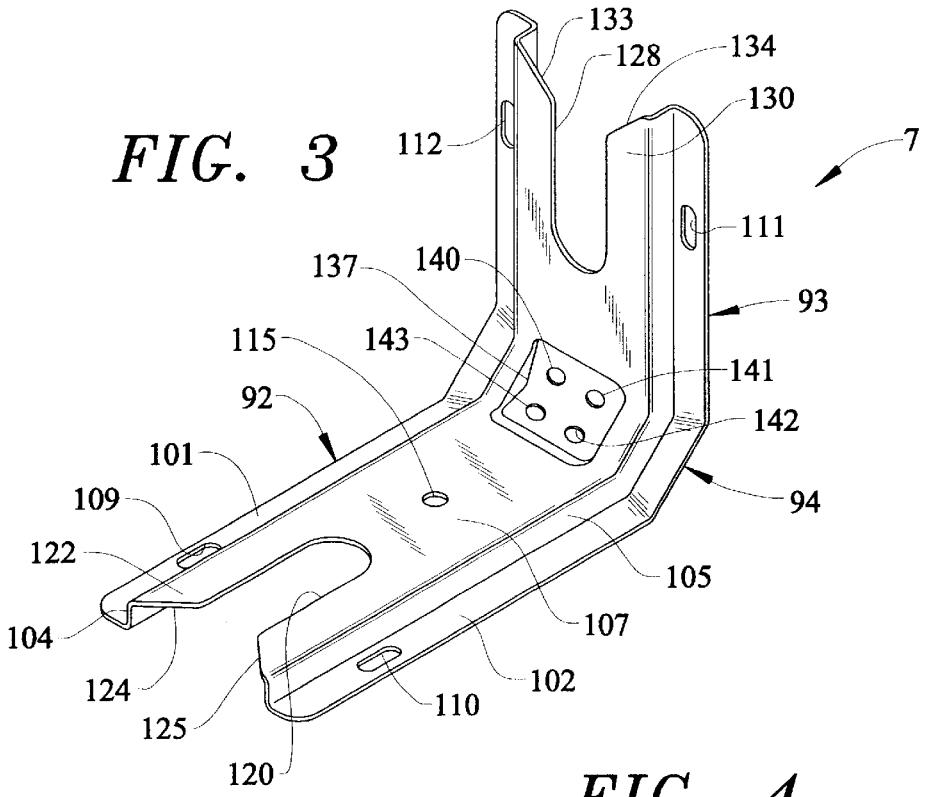
FIG. 3 is a perspective view of the anti-tip bracket of FIG. 1.
Figure 4:
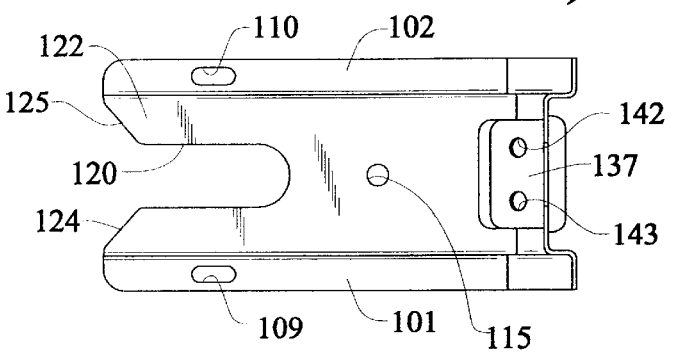
FIG. 4 is a bottom plan view of the anti-tip bracket of FIG. 3.
Figure 5:
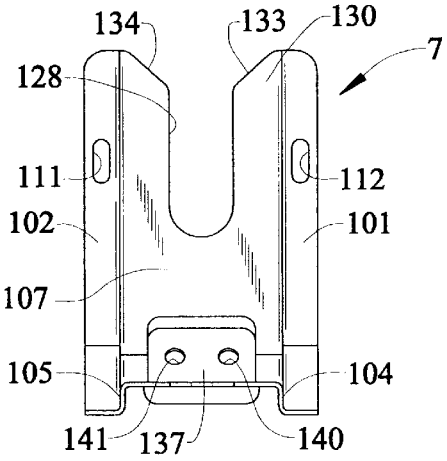
FIG. 5 is a rear elevational view of the anti-tip bracket of FIG. 3.
Figure 6:
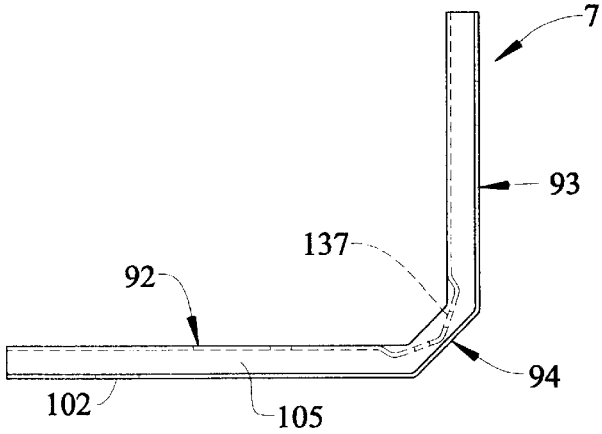
FIG. 6 is a side elevational view of the anti-tip bracket of FIG. 3.

With initial reference to FIGS. 1 and 2, an appliance anti-tip device constructed in accordance with the present invention is shown in connection with an electric range 2. Range 2 includes a cabinet 4 having a front panel 5, side panels 6, with the foremost side panel 6 being shown having a lower rear portion broken away to depict an anti-tip bracket 7 in accordance with the present invention, and a range top 8. Range top 8 can take various forms in a manner known in the art. In the embodiment shown, range top 8 incorporates various surface heating elements 11–14. Cabinet 5 further includes a rear, upstanding control panel 18. Control panel 18 supports a plurality of knobs 21–24 for controlling the activation/de-activation of surface heating elements 11–14 respectively. Furthermore, control panel 18 is shown to include a central control and display unit, generally indicated at 26, for use in controlling upper and lower ovens 29 and 30 respectively.

At this point, it should be noted that, although range 2 is shown to include both upper oven 29 and lower oven 30, it should be understood that the anti-tip bracket 7 of the invention is also applicable to more conventional ranges having a single, large upper oven and a storage drawer or the like there below. In addition, anti-tip bracket 7 can also be utilized with various other appliances, such as dishwashers. In any event, in the embodiment shown, upper oven 29 has associated therewith a door 33 which can be pivoted by means of a handle 35. Door 33 preferably includes a window 37 for viewing the interior of oven 29. In a similar manner, lower oven 30 has associated therewith a door 40, a handle 42 and a window 44. In a manner known in the art, ovens 29 and 30 define respective oven cavities (not separately shown).

Range 2 is adapted to be mounted upon a supporting surface 50, such as a kitchen floor or the like, and against an upstanding wall 54. More specifically, a plurality of leg members, two of which are indicated in FIGS. 1 and 2 at 76 and 77, respectively extend from front and rear portions of cabinet 4 along side panel 6. Of course, corresponding leg members are also provided on the opposing side of range 2. In any event, the various leg members 76 and 77 are preferably vertically adjustable to also act as levelers for range 2. Such type of leg leveler arrangements are widely known in the art of appliances, including ranges and refrigerators, such that the general function of leg members 76 and 77 does not form part of the present invention. In general, each leg member 76, 77 includes a threaded shaft 80 and a foot 82. However, in accordance with the present invention, it is important to note that leg members 76 and 77 maintain cabinet 4 of range 2 at a position spaced, to at least some extent, above supporting surface 50.

Reference will now be made to FIGS. 3–6 in describing the preferred construction for anti-tip bracket 7. As shown, bracket 7 is generally L-shaped and includes a first leg 92, a second leg 93 and a generally central, interconnecting portion 94. In the most preferred embodiment, first and second legs 92 and 93 are arranged perpendicular to each other, while central portion 94 is angled therebetween such that central portion 94 forms an obtuse angle with each of the first and second legs 92 and 93. Each of legs 92, 93 is defined by a pair of outwardly extending side flanges 101 and 102, upstanding walls 104 and 105 and a connecting portion 107. The side flanges 101 and 102 of legs 92 and 93 are provided with respective apertures 109–112. In the most preferred embodiment, apertures 109–112 are preferably, slightly elongated to permit a limited degree of adjustability in mounting of bracket 7 as will be detailed more fully below.

As clearly shown in these figures, first leg 92 is specifically designed to be longer than second leg 93. For example, in one preferred form of the invention, first leg 92 is in the order of 5½ inches (14 cm) in length, while second leg 93 is 4⅜ inches (11 cm). In addition, first leg 92 includes an additional aperture 115 provided in connecting portion 107. First leg 92 also includes a slot 120 formed within connecting portion 107, with slot 120 opening at a terminal end 122 of first leg 92. As clearly shown, terminal end 122 preferably tapers at 124 and 125 leading into slot 120.

In a similar manner, second leg 93 is formed with an elongated slot 128 which opens at an associated terminal end 130. Terminal end 130 also tapers at 133 and 134 leading into slot 128. In the preferred embodiment shown, each of slots 120 and 128 is approximately ½ inch (1.25 cm) in length, while having a width of approximately 3/16 inch (0.50 cm). Central portion 94 preferably includes a recessed section 137. As perhaps best shown in FIGS. 3 and 6, recessed section 137 is generally V-shaped in cross-section. As also clearly shown in these Figures, recessed section 137 is preferably formed with a plurality of holes 140–143.

With this construction, bracket 7 can be mounted to supporting surface 50 and/or wall 54 with a selected one of first and second legs 92 and 93 being supported upon surface 50. In either position, side flanges 101 and 102 will directly abut supporting surface 50, while connecting portion 107 will be spaced above and substantially parallel to surface 50 due to the presence of upstanding walls 104 and 105. As will be further discussed below, bracket 7 can be mounted in its desired position, preferably through the use of various mechanical fasteners extending through one or more of apertures 109–112, aperture 115 and holes 140–143. Once bracket 7 is mounted in its desired location, range 2 can be slid back into a position wherein rear leveling leg 77 can be captured by bracket 7. More particularly, foot 82 of leveling leg member 77 is adapted to slide beneath a respective connecting portion 107, while threaded shaft 80 protrudes through a respective slot 120, 128.

Figure 7:
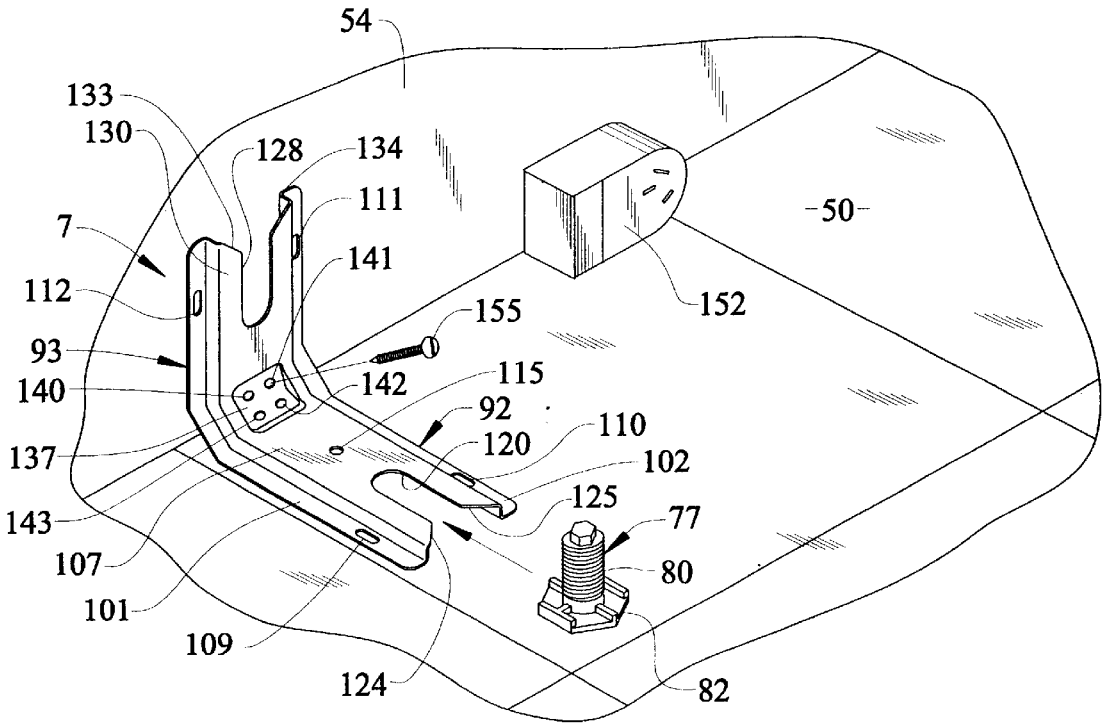
FIG. 7 illustrates the anti-tip bracket of the invention in a first mounting position.
Figure 8:
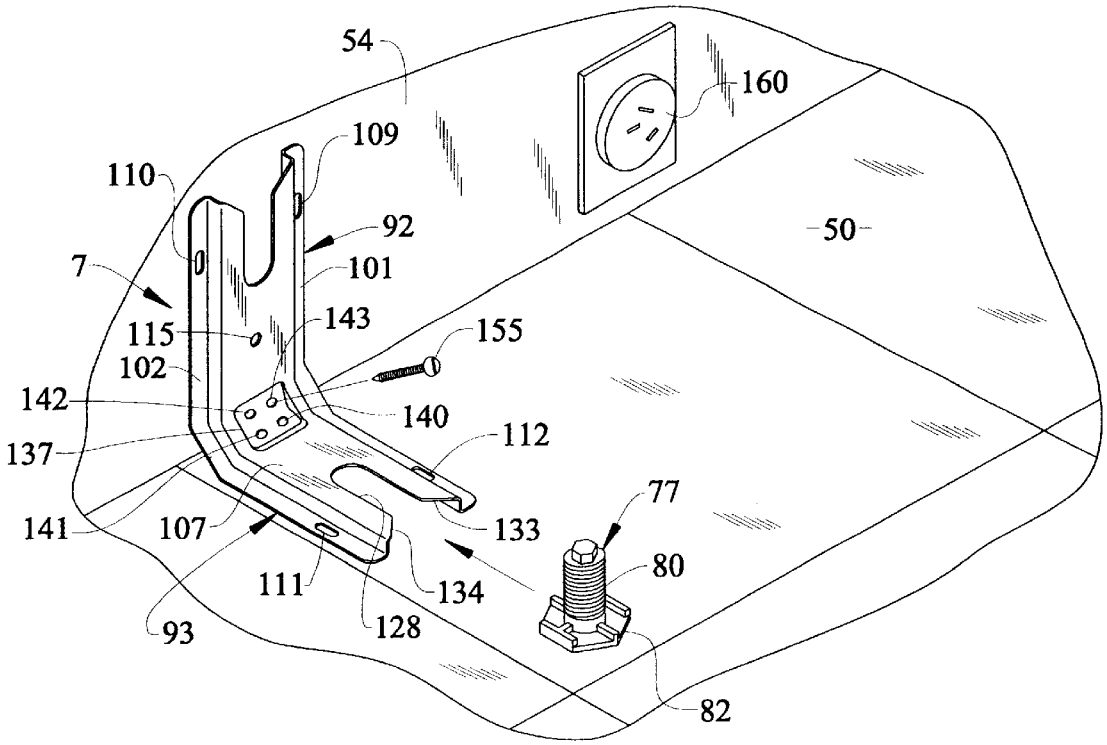
FIG. 8 illustrates the anti-tip bracket of the invention in an alternative mounting position.

FIGS. 7 and 8 will now be referenced to more fully describe the versatile nature of bracket 7 based on the different ways in which bracket 7 can be easily, selectively repositioned to assume various configurations for use in establishing and maintaining a desired positioning for range 2. With initial reference to FIG. 7, shown protruding from upstanding wall 54, directly above supporting surface 50, is an electrical socket 152. When positioning range 2 for use, it is desired to assure that range 2 is maintained a requisite distance from electrical socket 152. That is, range 2 in this embodiment constitutes an electrical range which needs to be plugged into socket 152. Obviously, given the manner in which electrical socket 152 protrudes from wall 54, range 2 will have to be spaced from wall 54. Unfortunately, many consumers installing a range 2 will have a tendency to plug the range 2 in and then force range 2 as far back to upstanding wall 54 as possible. More preferably, it is desired to establish and maintain a reasonable spacing for range 2. In connection with the present invention, bracket 7 is arranged with first leg 92 extending along supporting surface 50 and second leg 93 extending up wall 54. Given the difference in lengths of first and second legs 92 and 93, it will be appreciated that slot 120 is spaced further from upstanding wall 54 in this configuration than slot 128 would be if second leg 93 was positioned along supporting surface 50. In any event, in this position, bracket 7 can be secured, such as through the use of various screws 155 which extend through bracket 7 at selected ones of apertures 109–112, aperture 115 and holes 140–143. In this figure, a single screw 155 is only shown aligned with hole 141 for the sake of simplicity.

With this mounting, it should be realized that bracket 7 is adapted to be aligned with a left rear leveling leg member 77 of range 2. For the sake of clarity, range 2 has not been shown in FIG. 7 but rather only leveling leg member 77 is depicted. In any event, when range 2 is shifted back towards wall 54, leveling leg member 77 will be shifted until foot 82 is received beneath connecting portion 107 and threaded shaft 80 is received within slot 120. Any slight misalignment of range 2 relative to bracket 7 will cause the tapered portions 124 and 125 of terminal end 122 to guide threaded shaft 80 into slot 120. Of course, if desired, a second bracket 7 could be provided on the other side of protruding electrical socket 152 at a distance equal to the lateral spacing between the respective rear leveling leg member 77 of range 2. However, it should be realized that a single bracket 7 could also be employed. In any event, given that protruding electrical socket 152 is of a type commonly found in the art and the positioning of rear leg members 77 at a rear portion of range 2 is pre-established, bracket 7 is specifically designed to provide a desired spacing for range 2 from upstanding wall 54.

On the other hand, it is also known in the art to employ a recessed electrical socket such as that indicated at 160 in FIG. 8. Obviously, since socket 160 does not protrude from wall 54 to the extent of socket 152, range 2 can be positioned further against wall 54. With such a mounting arrangement, bracket 7 is reversed such that first leg 92 is arranged to extend up wall 54 and second leg 93 extends along supporting surface 50. Again, bracket 7 is fixed in a desired position by means of one or more screws 155. In the embodiment shown, screw 155 is aligned with hole 143 and is adapted to extend through wall 54 and into a wooden footer 165 as clearly shown in FIG. 2.

With this arrangement, range 2 will be able to be positioned closer to wall 54 then in the configuration of FIG. 7 given that second leg 93 is shorter than first leg 92 such that slot 128 is actually located closer to wall 54 in FIG. 8 than slot 120 in FIG. 7. In any event, in a manner directly analogous to that described above with reference to FIG. 7, leveling leg member 77 will be received beneath connecting portion 107 of bracket 7 when range 2 is slid back into an operating position. Concurrently, threaded shaft 80 will be received within slot 128. Once in this position, range 2 cannot undesirably tip over as foot 82 would abut an underside of connecting portion 107.

Based on the above, it should be readily apparent that bracket 7 represents a versatile arrangement for establishing and maintaining a desired positioning for range 2 whereby range 2 cannot tip over during use. Due to its construction, bracket 7 can be mounted in different configurations depending upon the particular environment in which range 2 is to be located. In addition, by providing the various apertures 109–112, aperture 115 and holes 140–143, bracket 7 can be advantageously secured in the most convenient and efficient manner to one or more of supporting surface 50, wall 54 and/or footer 165. The inclusion of recessed section 137 not only enables the heads of screws 155 to be recessed, but advantageously enables the angling of holes 140–143 based on the overall mounting configuration.

Although described with reference to a preferred embodiment of the invention, it should be recognized that various changes and/or modifications could be made without departing from the invention. For instance, although the preferred embodiment relates to the use of bracket 7 in connection with range 2, bracket 7 could also be used in connection with other appliances. Actually, bracket 7 also has particular use in connection with the mounting of a dishwasher beneath a kitchen countertop. Furthermore, bracket 7 could simply be used in connection with establishing the proper positioning of other appliances relative to a wall or the like, such as in the case of a refrigerator, washing machine or clothes dryer. In general, the invention is only intended to be limited by the scope of the following claims.

We claim:

1. An appliance adapted to be placed upon a supporting surface adjacent an upstanding wall comprising:

a cabinet having front and rear end portions;

a plurality of supporting members depending from the cabinet for positioning the cabinet above a supporting surface, adjacent an upstanding wall, at least one of said plurality of supporting members being located at the rear end portion of the cabinet; and at least one bracket for establishing and maintaining a desired positioning for the cabinet, said bracket including:

a central portion;

a first leg projecting a first distance from the central portion in a first direction, said first leg defining a first terminal end of said bracket, said first leg being provided with a first slot leading from the first terminal end toward the central portion; and a second leg projecting a second distance, which is less than the first distance, from the central portion in a second direction which is angled with respect to the first direction, said second leg defining a second terminal end of said bracket, said second leg being provided with a second slot leading from the second terminal end toward the central portion, wherein the bracket is adapted to be secured to one of the supporting surface and the upstanding wall with at least a portion of a selected one of the first and second legs extending above the supporting surface for receiving one of the plurality of supporting members in a respective one of the first and second slots.

2. The appliance according to claim 1, wherein the bracket is generally L-shaped in cross-section.

3. The appliance according to claim 1, wherein each of the first and second terminal ends tapers into a respective one of the first and second slots.

4. The appliance according to claim 1, wherein each of the first and second legs includes a pair of side flange portions and a raised, connecting portion.

5. The appliance according to claim 4, further comprising: a plurality of apertures formed in the pair of side flange portions.

6. The appliance according to claim 5, further comprising: an aperture formed in the connecting portion of the first leg.

7. The appliance according to claim 1, wherein the central portion includes a recessed section.

8. The appliance according to claim 7, wherein the recessed section is generally V-shaped in cross-section.

9. The appliance according to claim 7, further comprising: a plurality of holes extending through the bracket within the recessed section.

10. The appliance according to claim 1, wherein the central portion forms an obtuse angle with each of the first and second legs.

11. A bracket adapted for use in establishing and maintaining a position of an appliance comprising:

a central portion;

a first leg projecting a first distance from the central portion in a first direction, said first leg defining a first terminal end of said bracket, said first leg being provided with a first slot leading from the first terminal end toward the central portion; and a second leg projecting a second distance, which is less than the first distance, from the central portion in a second direction which is angled with respect to the first direction, said second leg defining a second terminal end of said bracket, said second leg being provided with a second slot leading from the second terminal end toward the central portion.

12. The bracket according to claim 11, wherein the bracket is generally L-shaped in cross-section.

13. The bracket according to claim 11, wherein each of the first and second terminal ends tapers into a respective one of the first and second slots.

14. The bracket according to claim 11, further comprising: a plurality of apertures formed in the pair of side flange portions.

15. The bracket according to claim 14, further comprising: an aperture formed in the connecting portion of the first leg.

16. The bracket according to claim 11, wherein the central portion includes a recessed section.

17. The bracket according to claim 16, wherein the recessed section is generally V-shaped in cross-section.

18. The bracket according to claim 16, further comprising: a plurality of holes extending through the bracket within the recessed section.

19. The bracket according to claim 11, wherein the central portion forms an obtuse angle with each of the first and second legs.

* * * * *